US006547702B1

(12) United States Patent
Heidecke

(10) Patent No.: US 6,547,702 B1
(45) Date of Patent: Apr. 15, 2003

(54) EXERCISE DEVICE

(75) Inventor: Steven Heidecke, Sarasota, FL (US)

(73) Assignee: Innovative Applications, Inc., Oak Brook, IL (US)

( * ) Notice: Subject to any disclaimer, the term of this patent is extended or adjusted under 35 U.S.C. 154(b) by 0 days.

(21) Appl. No.: 09/802,819

(22) Filed: Mar. 10, 2001

Related U.S. Application Data

(63) Continuation-in-part of application No. 09/538,576, filed on Mar. 29, 2000.

(51) Int. Cl.[7] ..... A63B 21/00
(52) U.S. Cl. ..... 482/62; 482/57
(58) Field of Search ..... 482/2, 57, 8, 1, 482/3, 9, 54, 4, 62, 95, 96; 601/23

(56) References Cited

U.S. PATENT DOCUMENTS

| | | | | | |
|---|---|---|---|---|---|
| 3,662,747 | A | * | 5/1972 | Williams | 482/57 |
| 5,378,214 | A | * | 1/1995 | Kreitenberg | 482/57 |
| 5,449,334 | A | * | 9/1995 | Kingsbury | 482/57 |
| 5,785,631 | A | * | 7/1998 | Heidecke | 482/57 |
| 6,066,073 | A | * | 5/2000 | Stearns et al. | 482/57 |

* cited by examiner

*Primary Examiner*—Jerome W. Donnelly

(57) ABSTRACT

An exercise device is provided which includes a surface for supporting a body of a user and a frame(s) for supporting the surface(s) above a floor. Resistance device(s) are connected to the device for providing resistance to movement of the user. A mechanism(s) may be provided for changing the orientation of the surface relative to the floor during an exercise routine. Also mechanism(s) may be provided for changing the orientation of the resistance devise(s) relative to the floor during an exercise routine. And mechanism(s) may be provided for changing the orientation of the surface (s) and the resistance devise(s) relative to the floor and to each other during an exercise routine. The resistance devise (s) may include component(s) for converting user motion into energy, electricity, etc. to power the exercise devise. Display device(s) may be provided to display various information relating to an exercise routine(s) to the user and to other(s). Computer control(s) may be included for controlling the amount of resistance provided by the resistance device(s) and for controlling the orientation of the support surface(s) relative to the floor and to hip extension and flexion. Memory device(s) may be associated with the computer control for storing exercise routine(s), recording the results of performed exercise routines and other information. Input device(s) may be provided with the computer control for user input information and output device(s) may also be associated with the computer control for outputting the results of performed exercise routine(s) and other information.

39 Claims, 6 Drawing Sheets

EXERCISE DEVICE

This application is a continuation-in-part of application Ser. No. 09/538576 filed on Mar. 29, 2000 entitled "EXERCISE DEVICE", inventor Steven Heidecke.

BACKGROUND OF THE INVENTION

The present invention relates to exercise devices and in particular, to a computer controlled exercise device, an exercise device which supports a user's body and which support can be rotated to various inclined positions and may be interchangeable to allow varying degrees of hip flexion and extension and may allow varying positions of a user's arms, an exercise device that allows the user to generate energy to power said exercise device.

Exercise devices, machines, etc. are well known and include bicycle and bicycle type devices, machines, etc. treadmills, running, climbing, stepping, rowing, cross country skiing, elliptical, hybrids of motions, machines, etc. Many of these devices have controls for varying a resistance of the part engaged by the user as well as some type of display device for providing information to the user. For example, U.S. Pat. No. 4,613,129 discloses an exercise bicycle which includes a visual display unit and an electronic control which displays programmed exercise routines as well as displaying time, load or resistance applied to the user, speed of exercise by the user and user's pulse rate. The automatic program mode of operation may provide routine such as simulating riding of the bicycle up and down hilly terrain only by varying the resistance of the pedals and visually displaying an increase on a visual graph.

U.S. Pat. No. 5,853,351 discloses an exercise devise that adjust a workload according to heart rate and correlating with a formula based upon the user's heart rate, age, gender, weight, height, etc. This is all that it allows for and does not does not allow for mechanical configurations that benefit the user nor does it utilize self generated energy to power the devise.

U.S. Pat. No. 5,785,631 discloses an exercise apparatus that includes a support surface for a user, a display, and a computer control that controls resistance load and the orientation of the support surface for the user relative to the floor. The support surface does not allow orientation of the upper and lower body to adjust relative to themselves thus allowing variations of hip flexion and extension other than the amount necessary to move the resistance device provided for. Nor does it provide for a user generating system that has the capacity to provide energy to power the components that require power.

U.S. Pat. No. 5,685,804 discloses an exercise devise that allows a user's feet to travel along an elliptical path of travel. The path of travel's angle can be altered so that the stepping motion as claimed may resemble similarities of cross country skiing, walking, jogging, stepping, running, climbing. The devise does not allow for any additional support for the user other than the feet of the user. It only angle that the feet of the user travels on to adjust and does not allow the users body to change from an upright/horizontal position to a vertical position. Nor does it provide for the user's movement against the exercise devise to self generate the electrical energy requirement to power the exercise devise.

U.S. Pat. No. 5,054,774 discloses an exercising machine useable by a wide variety of persons in which exercise routines can be pre-programmed for individuals and results of each individual's exercise output can be displayed and stored on computer memory. An upper body support can be positioned either in a horizontal position or in an upright position.

U.S. Pat. No. 4,938,474 discloses an exercise apparatus which simulates stair climbing and determines the amount of exercise based upon the speed of a flywheel. The speed of the flywheel is controlled by a motor and sensor to determine the amount of exercise. This system does not allow for the user generating an amount of energy to provide power for the exercise device.

U.S. Pat. No. 4,372,551 discloses a stress table with a resistance device attached thereto in which the body support member and resistance device can pivot between vertical and horizontal to allow the user to exercise throughout a range of angled orientations. No display device is provided, nor is there any ability to provide a computer controlled exercise routine.

U.S. Pat. No. 4,358,105 discloses an exercise apparatus of the type that provides automatically controlled resistance levels that are unpredictable by the user.

U.S. Pat. No. 3,675,640 discloses an exercise apparatus in which a pre-programmed load is provided to an exercise device used by a user and the results of the user's exercise efforts and including various physiological parameters of the user such as heart rate and rhythm, blood pressure, respiratory volume and rate are measured and stored.

SUMMARY OF THE INVENTION

In an embodiment, the present invention provides an exercise device which may include a surface for supporting a body of a user. The surface is supported above a floor by a unitary or multiple piece frame. The surface may also be mounted to the frame in such a manner so that it can change orientation relative to the floor during an exercise routine. For example, the surface may pivot forward and backward so that an angle of inclination of the back rest and seat surface relative to the floor and to the resistance means may change between horizontal, vertical and forward beyond vertical. In anther embodiment the resistance devise may be mounted to the frame in such a manner that the orientation of the resistance devise(s) can change relative to the floor and to the back rest and seat support surface. Also the back rest, seat surface, hand grips and the resistance means can change orientation in relation to each other and to the floor if so equipped, independently and or in any combo thereof. The surface may also pivot or rotate side to side about a horizontal axis or rotate up to 360 degrees or more about a vertical axis either while the surface remains horizontal or while the surface is also pivoting about a horizontal axis. And in another embodiment the orientation of the graspable support system may be adjusted to allow for changes in positions. Appropriate mechanical arrangements can be provided to allow the orientation change, such as worm gears, planetary gears, hydraulic actuators, etc. The orientation changing device could be manually operated or could be automatically controlled through an electric motor, hydraulic pump, etc. Such a unit provides physiological as well as psychological benefits.

In another embodiment, the invention provides an exercise device which is capable of being computer controlled via an integral computer, or from a separate computer via instructions received from a magnetic card, disk, direct or indirect connection to a computer via modem or similar arrangements. The computer control will provide instructions to the exercise device to control the operation of the device, such as varying the resistance provided, automatically changing the orientation of the support surface, the resistance means, if available, displaying information to the user, varying time durations for resistance levels and orientation positions, etc. to provide an infinite variety of duration, resistance and orientation combinations. Further, the computer control may control memory devices so that the operation of the user may be recorded, either locally or at a remote site via modem, wired or wireless transmission, as well as displaying the results of the user's actions. Various types of information relating to the use can be recorded such as date and time of use, duration of use, functions perform, energy expended by the user, heart rate at select intervals, blood pressure, respiration rates, etc. Many types of information, physiological, etc. whether recorded or not relating to the use such as energy expended by the user, heart rate at select intervals, blood pressure, respiration rates, etc. can be used via the computer to control the functions of the exercise. The computer may use physiological response from the user during the workout to control the functions of the exercise devise in real time. In fact, a large number of parameters relating to the user's exercise use can be used for controlling the exercise devise and or to be recorded as the exercise is performed so that the user, a coach or trainer, or a cardiac therapist, medical personal, or others will be able, through appropriate software and other means available, to view the entire exercise program, or parts or summaries thereof, and compare it to other workouts or to pre-programmed workouts and calculate or re-calculate workouts based upon parameters contained in the software for programming future exercise workouts etc.

A resistance device, could be engageable by the user and associated with the frame, is built into the unit to provide resistance to movement of the user such as at least leg or arm movement. For example, a bicycle pedal arrangement could be provided for leg resistance, rotatable cranks for arm resistance or pivoting or sliding devices for arm, leg or back engagement. Many types of resistance devices, components are known such as pivoting devices, sliding devices, weights on cables or levers, braking motors, generators, brushless generators, eddy current systems, magnetic systems, alternators, tightenable belts, friction rollers, etc. and could be substituted in the devices illustrated while still being within the scope of the present invention. The resistance devices may be adjusted manually, manually through electrical switches, or by means of a computer type control as described below.

Energy provided for the exercise device may be provided by one or more of the following; user generated with movement provided by the user against said resistance device, external power supply or supplies such as electrical outlets, batteries, etc. and in any combo thereof. The energy may provide the necessary power, electricity, etc. to supply all of the components that utilize energy, such components may include but are not limited to the displays, resistance devices, means for changing orientation, batteries, video games, controls, etc. This energy could be used to power all of the electronics that comprise the electronics of the exercise devise.

In an preferred embodiment the resistance devise would comprise of a generator type motor that when moved by the user produces energy, electricity, etc. which supplies the exercise devise. Thus eliminating the need for an outside source of energy, such as an electrical outlet, etc.

Also provided is a display device, which may be a cathode ray tube, liquid crystal display, series of LED's or other appropriate display units for displaying selected information relating to use of the device to the user. The information displayed could include a predetermined exercise program to be followed by the user, the results of the movement of the user against the resistance device and/or various monitored physiological parameters of the user such as pulse rate, respiration rate, blood pressure, etc. The display would also show set up information as well as information input by the user through an appropriate input device.

Preferably the device includes a computer-type control with one or more microprocessors for controlling the level of resistance applied by the resistance device either in response to user input resistance levels or a pre-programmed exercise routine and or via physiological response. Thus the control will be connected to a memory device and will also be connected to the display device and the resistance device.

In a preferred embodiment of the invention the control will also control a device for varying the orientation of the support surfaces of the back rest and seat, the orientation of the resistance means, the graspable support system or a combo thereof so that the attitude of the user and or the degrees of hip flexion and extension may vary during the exercise routine in accordance with a pre-programmed exercise routine or user input selections and or via physiological response.

For example, if the exercise device includes a bicycle pedal resistance device and or a graspable handle resistance device, the orientation of the support surface and or the orientation of the resistance means can vary during the exercise routine to simulate an upright bike, a recumbent bike, and or a rowing-cycling-climbing like arm motion and or a in any varying combination thereof going uphill, level, and going downhill in conjunction with varying resistance levels at the resistance device(s). Also, by pivoting side to side and about a vertical axis will allow the exercise device to simulate turns, both on level ground and in conjunction with simulated hills. Not only will this provide additional user interest in the use of the exercise device, Applicant believes that psychological and physiological benefits result from exercise being performed at different orientations relative to a vertical and varying degrees of hip flexion and extension, due to the varying effects of gravity and hip angularity on the exercise being performed. Interactive games or videos, displayed on the display devise and controlled thru various input devises, including buttons spaced away from the display devise, can be played which would cause changes to the duration, resistance and orientation of the support, etc. as the game or video progresses.

Preferably the results of the exercise routine performed by the user are stored on memory, either on a non-removable hard disk type of memory or to individual floppy disks or magnetic cards which can be removed from the exercise device for further use, such as comparison to subsequent exercise routines performed by the user or for review by appropriate trainers, medical or therapy personnel. The exercise device may also include a remote transmission device such as a modem so that the results of the exercise routine can be transmitted to a remote location by either real time transmission as the exercise routine is being performed for optionally monitoring at a remote location or after the exercise routine has been completed, and other pre-programmed exercise routines can be transmitted to the exercise device for use by a user.

DETAILED DESCRIPTION OF THE PREFERRED EMBODIMENTS

Figure 2:
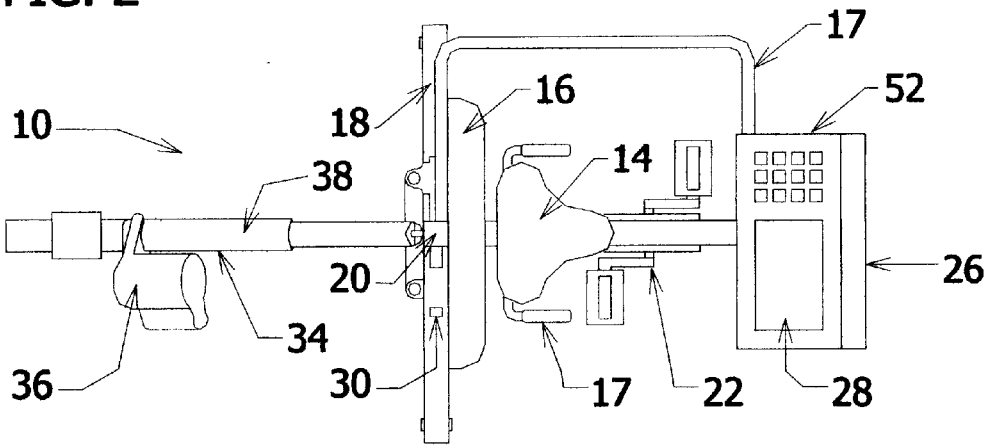
FIG. 2 is a plan view of the exercise device of FIG. 1.
Figure 1:
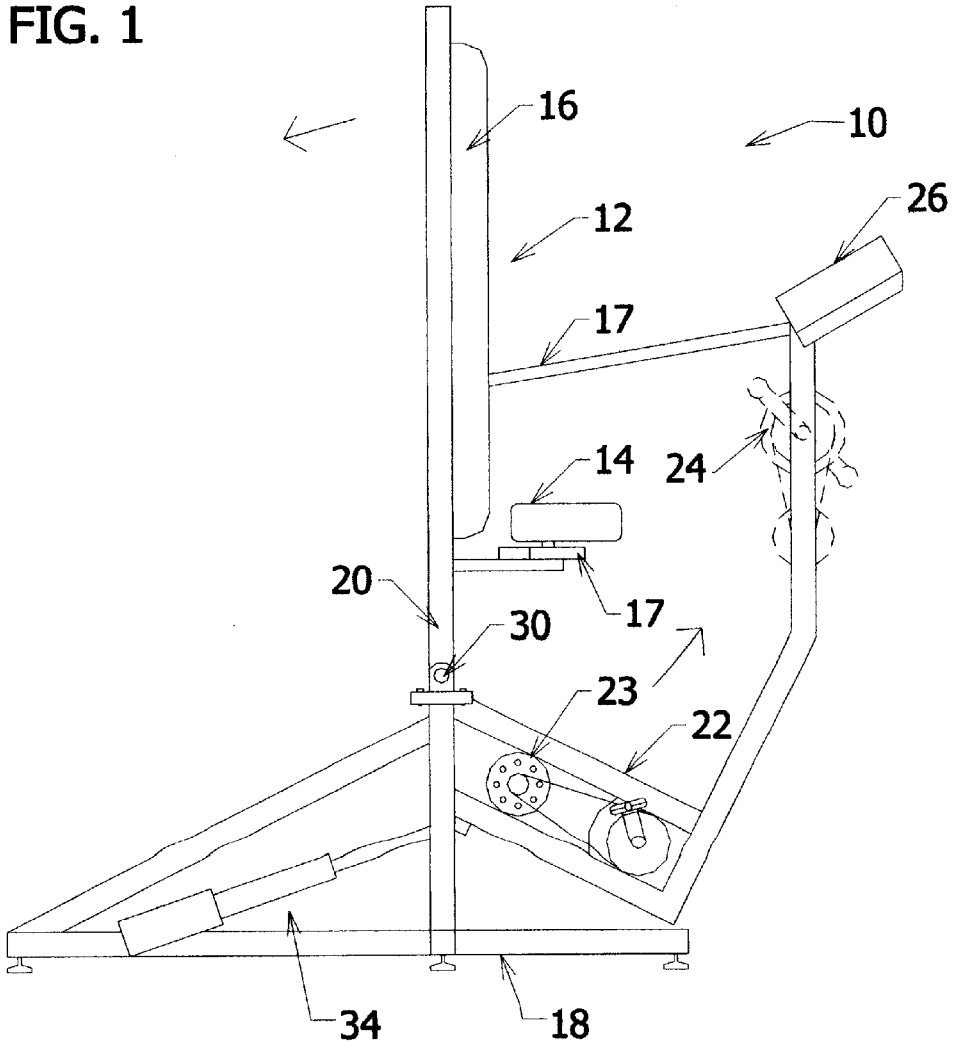
FIG. 1 is a side elevational view of an exercise device with a user support surface in a first orientation.
Figure 3:
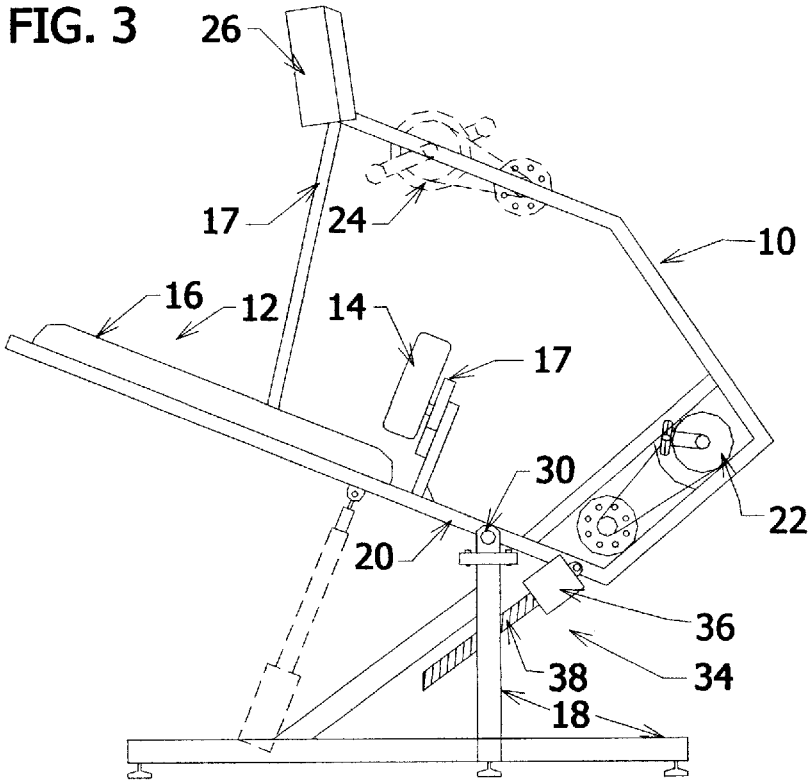
FIG. 3 is a side elevational view of the device of FIG. 1 with the user support surface in a second orientation.

FIGS. 1–3 schematically illustrate an exercise device generally at 10 which include a support surface 12 which includes a seat 14 and a back rest 16. A pair of hand grips 17 may also be provided below the seat 14 to provide the user with additional support. The support surface 12 is carried on a main frame 18 which supports the surface above a floor. The back rest 16 could be a foam covered board or could be a contoured back rest, as desired. The seat 14 could be formed integrally with the back rest 16 or it could be formed separately. The hand grips 17 may be secured to form integrally with the frame 18 and or sub-frame 20 and may wrap around to be directed in a direction that a user would face when seated on the seat 14. Depending from the back rest 16 is a sub-frame 20 which carries on it a device 22 for providing resistance to the legs of a user. Alternatively, or in combination, a resistance device 24 may be provided for providing resistance to arm movement of the user. The seat 14 and the hand grips 17 should be adjustable relative to the position of the resistance device(s) 22, 24 to accommodate different sized users.

In the embodiment illustrated in FIGS. 1–3, the resistance device(s) is illustrated as comprising a rotatable pedal or crank structure as is common in some exercise devices to simulate bicycle riding or an arm cranking motion and may include a means for generating energy, electricity, etc. Many types of resistance devices may have components such as pivoting devices, sliding devices, weights on cables or levers, pulleys, wheels, flywheels, braking motors, generators, brush less generators, eddy current systems, magnetic systems, alternators, tight enable belts, friction rollers, etc. and could be substituted for each other and may be utilized with or without each other in varying configurations while still being within the scope of the present invention. The resistance devices may be adjusted manually, manually through electrical switches, or by means of a computer type control as described below.

The energy, electricity, etc. provided for the exercise device may be provided by one or more of the following; user generated with movement provided by the user against said resistance device, external power supply or supplies such as electrical outlets, batteries, etc. and in any combo thereof. The energy, electricity, etc. may provide the necessary power to supply all of the components that utilize energy, such components may include but are not limited to the displays, resistance devices, means for changing orientations, batteries, video games, controls, etc.

In a preferred embodiment the resistance devise would include a generator type motor means 23 that when caused to move by the user produces energy, electricity, etc. which supplies the exercise devise. This energy, electricity, etc. could be used to power all of the electronics that comprise the electronics of the exercise devise. Thus eliminating the need for an outside source of energy, such as an electrical outlet.

Some motors/generators or other such type component means included in some resistance devices when caused to move by user generated movement creates an output of energy, electricity, etc. and such energy, electricity, etc. can power the following but are not limited to powering them; means for resistance, resistance devises, displays, controls, computers, means to change orientation, actuator(s), etc. Thus eliminating the need for an outside source of energy, such as an electrical outlet.

Secured to the sub-frame 20 is a display unit 26 which includes a display screen 28 for displaying selected information relating to the use of the device to the user. The display device could be a cathode ray tube, a liquid crystal display, including flat screens, helmets, goggles, etc. a series of LED displays, a combination of two or more of such displays, or other appropriate display types such as analog meters. The display unit 26 may also include an audible display device for providing various information, sound effects, music, etc. to the user.

The entire support surface 12, sub-frame 20, resistance (including appropriate energy, electricity, etc. producing generator/motor means 23) device(s) 22, 24 and the display unit 26 is pivotally attached to the main frame 18 at a pivot point 30 such that the orientation of the surface 12 relative to the floor may be changed. Depending upon the particular type of exercise device and resistance device utilized, an appropriate orientation changing device or mechanism may be provided for altering the orientation of the support surface 12 relative to the floor. For example, a manually actuated crank could be utilized which could have a crank handle, a large wheel or other appropriate manually graspable portion to allow for rotation of the support surface 12 relative to the main frame 18. Appropriate reducing gears and the like could be utilized as would be apparent to a person of ordinary skill in the art.

Alternatively, and preferably, an automated mechanism or actuating device 34 which may include an electric motor 36 driving a worm gear 38 which is secured between the sub-frame 20 and the frame 18 as illustrated in FIG. 3. (or an actuating device 34 secured to the sub-frame 20 below or above a pivot point 30 in the opposite, vice versa position as illustrated in FIG. 1 and FIG. 2) could be utilized to provide the relative rotation of the support surface 12 relative to the main frame 18. The motor 36 should be secured to the sub-frame 20 as illustrated in FIG. 3 (or motor 36 secured to the frame 18 as illustrated in FIG. 1 and FIG. 2). Other types of devices including hydraulic actuators, helical screws operating through appropriate pivoting linkages, threaded driveshaft and meshing gears, etc. (as an example illustrated in FIG. 5 such as a gear system 35 which may include an electric motor) could be utilized as would be apparent to one of ordinary skill in the art to cause relative movement between the support surface and its sub-frame 20 and the main frame 18. The automated mechanism(s) 34, (33 in FIG. 4), (35 in FIG. 5) and (37 in FIG. 7) could be manually controlled by a user through appropriate switches, or could be automatically controlled by a computer control as described below.

Figure 4:
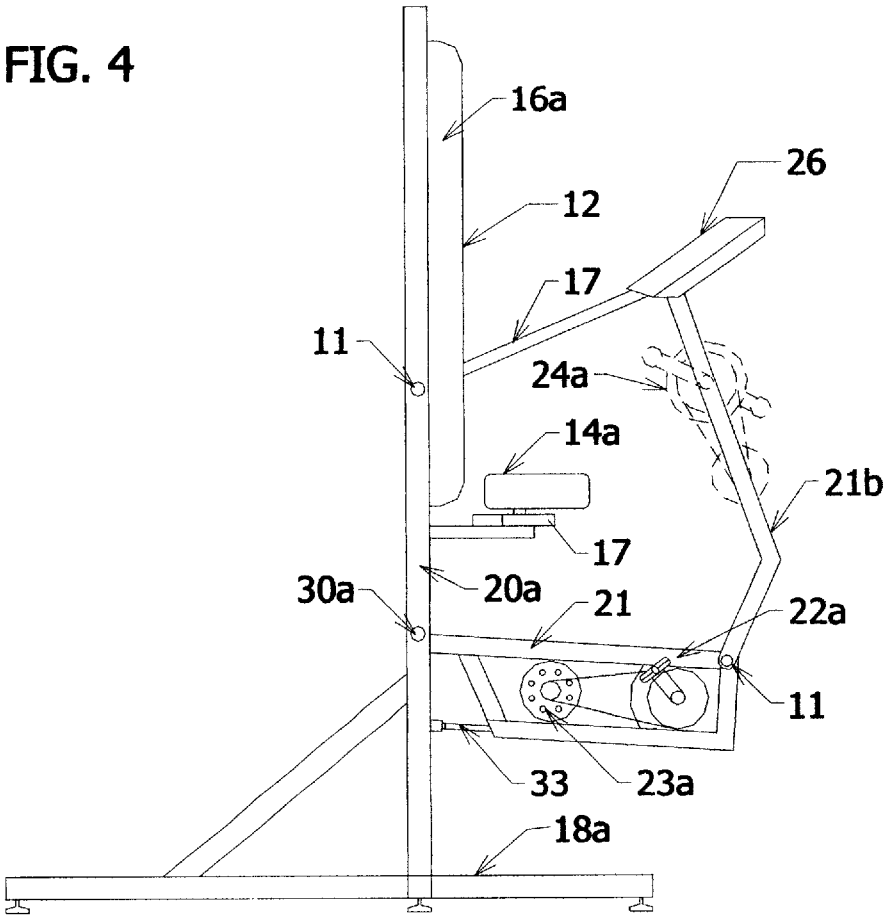
FIG. 4 is a plan side elevational view of an alternate embodiment of an exercise devise of FIG. 1 in accordance with the invention.
Figure 5:
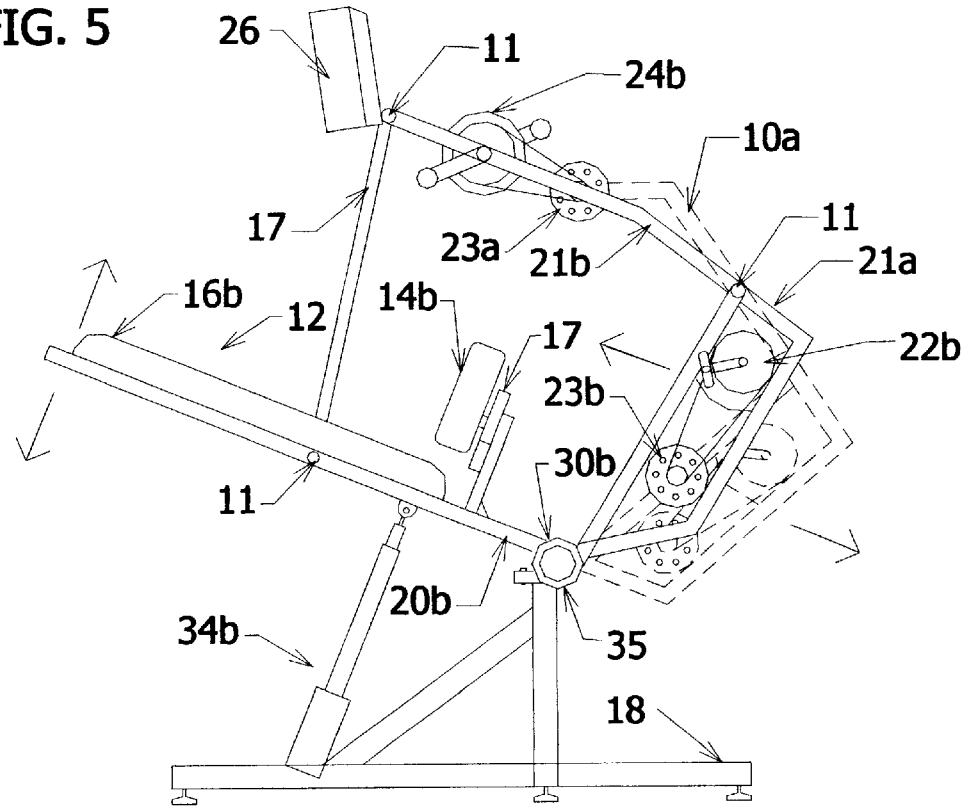
FIG. 5 is a plan side elevational view of an alternate embodiment of an exercise devise of FIG. 1 in accordance with the invention.
Figure 6:
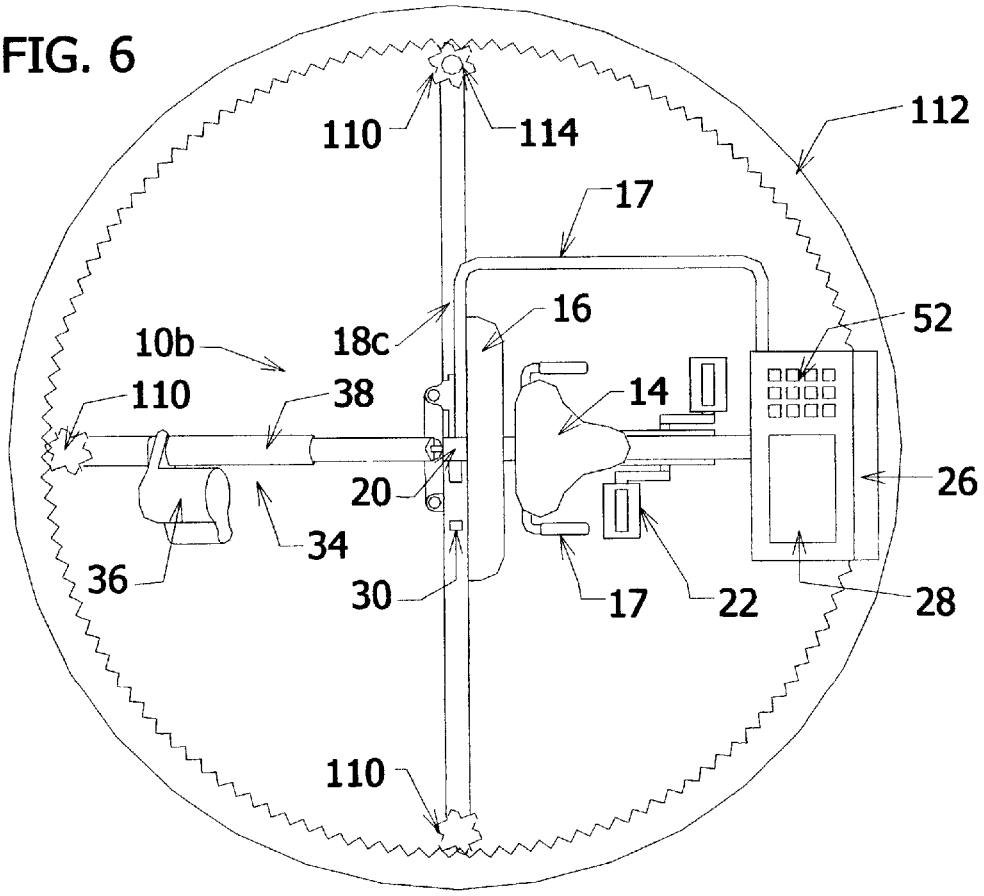
FIG. 6 is a plan view of an alternate embodiment of an exercise devise of FIG. 1 in accordance with the invention.

Although the preferred embodiment shows the support surface pivoting about a single horizontal axis to provide front to rear tilting relative to the floor, other types of movement and changes in orientation of the support surfaces and resistance devices relative to the floor and each other are contemplated by the present invention as in FIGS. 4–6.

FIG. 4 illustrates an embodiment that has the main frame 18*a* sitting on the floor and extending upward so as to accommodate seat, back rest surfaces and if so equipped pivot point(s) 11 for the hand grips. The seat 14*a*, and back rest 16*a* surfaces are fixed in relation to the floor by being attached to the main frame. A sub frame 21 extends from a pivot point 30*a* between the main and sub frame and may include another sub-frame 21*b* secured from point 11. The resistance devices, rotatable pedals and or crank structures 23*a*, 24*a* are attached to the sub frame and in a preferred embodiment would include a generator type component 23*a* as mentioned herein. The frame would incorporate the same orientation type mechanisms as mentioned herein, such as a liner actuator 33 or other such means for orientation as mentioned herein; an example is illustrated in FIG. 5 such as a gear system 35. Thus allowing the orination of the sub frame and if so equipped the hand grips to change in relation to the floor and to the seat and back rest surfaces.

Another such example FIG. 5 shows a main frame 18*b* sitting on the floor and two sub frames 20*b*, 21*a* and three if sub frame 21*b* is included. The seat 14*b* and back rest 16*b* surfaces being attached to one sub frame 20*b* and the resistance devices being attached to the other sub frame 21*a* and in a preferred embodiment would also include a generator type component 23*b* as mentioned herein. These sub frames, main frame and hand grips (hand grips may be pivotally connected at pivot(s) 11) are pivotally attached so that the orientation of the seat, back rest, hand grip surfaces and the resistance devices 23*b*, 24*b* may change orientation relative to the floor and to each other. The frame would incorporate the same orientation type mechanisms as mentioned herein, such as a liner actuator 34*b* or other such other means for orientation such as a gear mechanism device 35*a* for changing the orientation. The orientation of the sub frames may be changed thru one of each 34*b* and 35 or both sub frames may be changed thru liner actuator(s) or both sub frames may be changed with gear systems and or in any combination thereof.

Another example, FIG. 6 illustrates an orientation changing device for causing the exercise device to rotate about a vertical axis. The main frame 18*c* may include horizontally deposed gears 110 at each end of the frame to mesh with another part of the frame 18*c*, in this case, a large encircling gear 112. One or more of the end gears 110 may be driven by a motor 114 so that the entire fame 18*c* would rotate about an vertical axis thru a full 360 degree range and beyond. The motor 114 may be a reversible motor and can be controlled by a computer control as described below. Other types of mechanical arrangements such as powered gimbal arrangement, etc. could also be utilized to effect movement of the support surface about and along one, two or all of the three perpendicular axis. Actuators, rack gears or other arrangements, etc. could be provided to translate the frame linearly along any of the axis. In this fashion, the orientation of the support surface relative to the floor could be infinitely modified to put the surface in any relative position desired.

Figure 7:
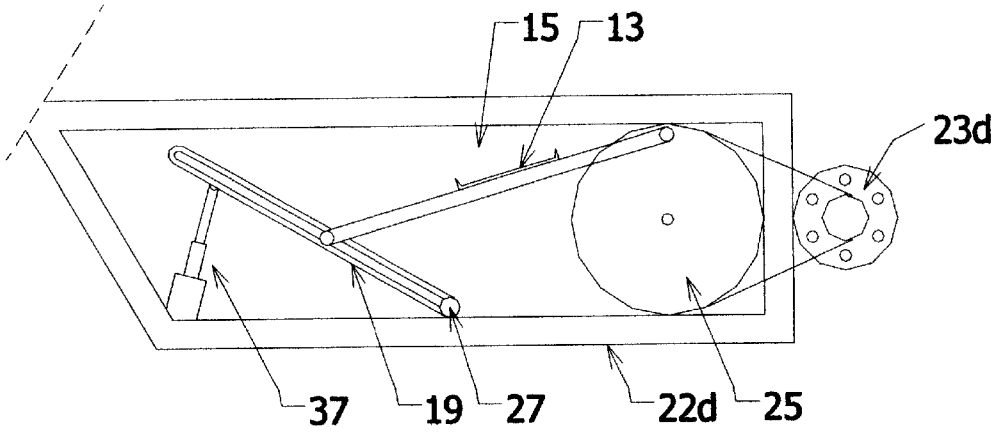
FIG. 7 is a plan view of an embodiment of an resistance devise in accordance with the invention.

FIG. 7 illustrates an embodiment of an resistance devise 22*d*, 24*d* that allows the user's feet, legs, arms, hands, limbs, etc. to travel on an oval, elliptical, curvalinier, etc. path of travel. This resistance devise may be utilized in any of the embodiments mentioned, and preferably would include a generator type component 23*d*. As shown in this embodiment these components, a wheel 25 and a track 19 are attached pivotally 27 to the frame and situated in a manner to allow rails 15 connected in between and pivotally on the wheel and into the track to move. Associated with the rails for 22*d* are foot supports 13. The configuration of the components may be setup in reverse as well and or other configurations that would allow the same or similar movement of the path of travel. Many other types of components and configurations can be arranged so that an oval, elliptical, curvaliner, etc. path of travel can be realized. The angle of the track may be adjusted via an actuator 37 or other such angle changing type means as previously mentioned herein thus allowing for the user to adjust an angle of travel of the user's feet, legs, hands, arms, limbs, etc. independent of the changes that may take place from the changes of orientation of the frame and sub frames. Said resistance devise may be used for the user's hands and arms as well and if so would incorporate appropriate hand supports for the user. There are many ways to allow curvaliner, elliptical, oval, circular, etc. paths, motion, etc. of travel for a user's feet, legs, arms, hands, limbs, torso, etc. and are contemplated in the invention. Other paths of motion and body parts of the user can also be seen in FIGS. 9–10–11.

Figure 8:
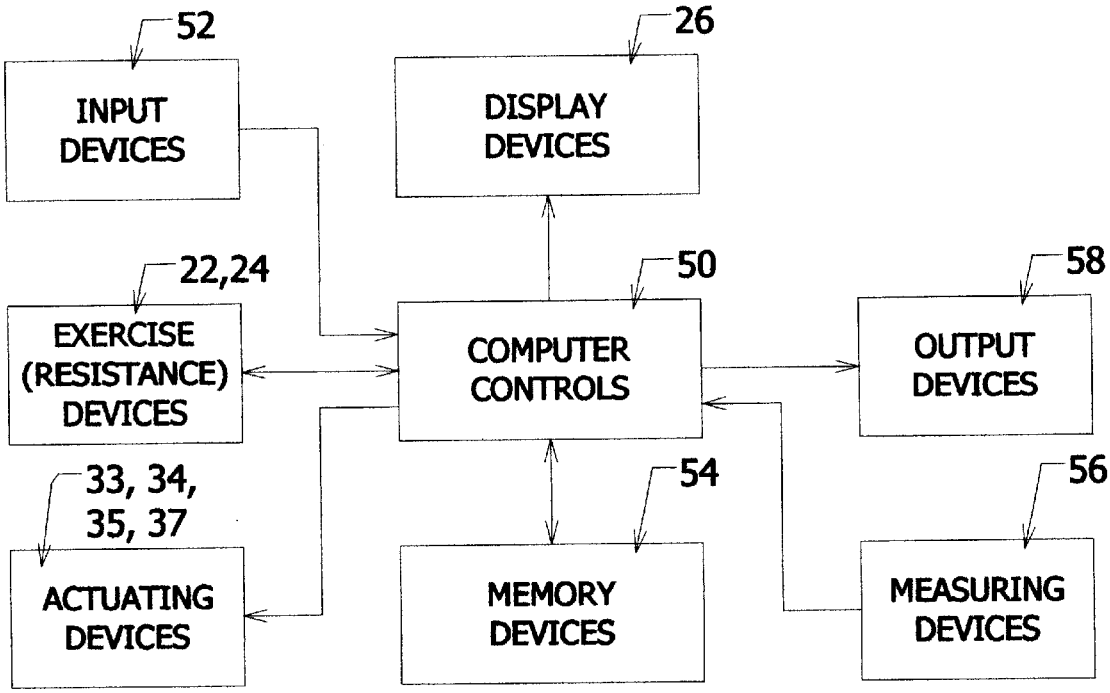
FIG. 8 is a schematic block diagram of the computer hardware and other devices utilized with the exercise device in accordance with the invention.

A schematic illustration FIG. 8 of a preferred computer control 50 including one or more microprocessors for the exercise devise 10 is illustrated in FIG. 8. In this figure the computer control 50 is shown schematically for receiving signals from and sending signals to various devices. An input device is shown schematically at 52 which could include one or more of keyboard input, touch screen input, an infra red or other wireless receiver, manually activated switch, including movement or orientation sensitive switch, an RS232 connection to some other input device such as another computer directly or through a modem and phone line, or some data storage device, etc. Also, a memory device 54 is illustrated as providing an input signal to and receiving an output signal from the computer control 56. The computer control 50 provides an output signal to the display device 26.

The memory device 54 may include both RAM and ROM memory as well as other types of storage devices such as hard disks, CD ROMS, magnetic tape or card devices, etc. A user, by appropriate inputs at the input device 52 will cause the computer control 50 to begin operation, perhaps by obtaining data from the memory device and displaying various information on the display device 26. For example, a user may input the user's code number and the computer control 50 will interrogate the memory device 54 to load a pre-selected exercise routine and provide a display of the routine on the display device 26. The user, by manipulation of the input device 52 could confirm selection of the individualized pre-programmed exercise routine, could modify the pre-programmed exercise routine, could generate a custom designed exercise routine or could select a generic pre-programmed exercise routine or could terminate operation of the exercise devise, which, if done during an exercise routine could also operate the actuating devise 34 and if so equipped with 33 and or 35 to and or 37 re-orient the exercise devise to an unloading position.

The schematic diagram also illustrates that various measuring devices 56 may be utilized to provide a signal to the computer control 50. Such measuring devices could include a pulse rate counter, a blood pressure sensor, respiration sensors and other similar types of physiological sensors as are well known to those of skill in the art. These devices would be attached to the user as known and the output from the measuring devices 56 could be directed through the computer control 50 to the display device 26 and to the memory device 54. Other measuring devises 56 could provide input to the computer control regarding the exercise devise 22 or and 24 if equipped including resistance level, degrees of orientation of support surface, R.P.M. or speed of exercise, number of repitions, duration, amps, watts, etc. The measuring devise 56 attached to the user may provide input to the control to modify the exercise routine, such as by changing the resistance level or surface orientation based on physiological response, such as to keep a pulse rate within a predetermined target zone, maintain other physiological parameters within a predetermined zone, and or respond to physiological responses to provide a variety of exercise variations or terminating operation if a dangerous condition is measured.

Once the user has selected an appropriate exercise routine, or, even without selecting an exercise routine, the user would begin preforming by applying a force against one and or both if so equipped of the resistance devices 22, 24 thus expending energy. In the preferred embodiment the motion by the user against the resistance devise would cause an output of energy, electricity, etc. and such energy, electricity, etc. may power the following but are not limited to powering them; means for resistance, resistance devises, displays, controls, computers, means to change orientation, actuator (s) and any such component(s) that requires energy, electricity, etc. The programmed routine may begin by user activation such as pressing a "start" button, beginning movement of the resistance devise, etc. The results of the user's force against the selected exercise device would be transmitted to the computer control 50 for display on the display device 26 and for temporary or permanent storage at the memory device 54. As appropriate, the information could also be directed to an output device 58 such as to an external storage device, over a modem/telephone line to a remote location, to a remote display or to a printer. As the user works through a pre-programmed exercise routine, or in response to appropriate user inputs through the input device 52, the computer control 50 will send appropriate signals to the resistance device(s) 22, 24 to vary the resistance to the leg, arm or other movement of the user. Also, the computer control 50 may supply an appropriate signal to the actuating device(s) depending on how the exercise devise is and if so equipped 34 and or 33, and or 35, and or 37, and or motor 114 to selectively cause the support surfaces 12 and resistance devise 22 attached with sub frame 20 to change orientation relative to the floor and if so equipped the resistance devise 22 attached with sub frame 21 to change orientation relative to the floor independent of the support surfaces 12 attached with frame 18 and or the support surfaces 12 attached with sub frame 20 and the resistance devise 22 attached with sub frame 21 to change orientation relative to the floor and to each other.

In a preferred embodiment of the invention the control will also control a device for varying the orientation of the support surfaces, the orientation of the resistance means or a combo thereof so that the attitude of the user and or the degrees of hip flexion and extension may vary during the exercise routine in accordance with a pre-programmed exercise routine or user input selections For example, in a particular embodiment illustrated, the resistance device 22 and simulates upright bicycle riding and in combination with the actuator 34 recumbent bicycle riding and varying combinations thereof and the exercise routine for interactive game or display(s) could simulate the pre-programmed exercise routine, simulate hill climbing, level surface riding and downhill riding. The display devise and input devises could be used to provide a virtual reality and or interactive environment so that actions or movements of the user cause modification of the program. As the program progresses through the various stages, the orientation of the support surface(s) could be automatically changed to conform to the resistance level simulated to give the user the actual sensation of going uphill or downhill in an upright supported, a recumbent or in any combination thereof. Also the sensation of turning could be accommodated by rotating side to side (pivoting about a horizontal which goes from front to back of the devise) and turning around a vertical axis. Translation of the devise, vertically or horizontally could also be used to further enhance the simulation.

Further, Applicant has determined that various physiological benefits are achieved in conducting various resistance exercises with or without the assistance of gravity and by varying the effect of gravity which comes from varying the orientation of the user's body who is performing the exercise. Thus, in cycle type exercise devices and in other types of exercise devices as well, the changing of the orientation of the support surfaces back rest, seat, and pedals relative to the floor and each other will provide differing exercise benefits.

As mentioned above, the results of the exercise routine performed by the user can be stored in the memory device 54, which includes storage on a fixed disk device or on removable floppy disks, or magnetic cards and can be sent to the output device 58 for transmission to a remote location. The results of the exercise program can be used in subsequent exercise routines for comparison purposes and/or can be reviewed by appropriate medical and therapy personnel to assist the user in developing further exercise programs.

The information stored on the memory device 54 and sent through the output device 58 can include the actual level of intensity, duration of exercise at that level, the angle/degree of orientation, including the degree of hip flexion and extension of the support surface(s) back rest, seat, hand grips and pedals/resistance means relative to the floor and to themselves or original position, plus measured information such as blood pressure, heart rate, respiration rate, etc.

Another type of output device 58 could be an audible or visual alarm which is operated by the computer control 50 in the event one of the measuring devices 56 measures a physiological parameter outside of a desired range, such as excessive pulse rate or blood pressure. In such an event, the computer control 50 might also terminate all resistance and operate the actuating devise 34 and or if so equipped 33 and or 35 and or 37 to reorient the exercise devise 10, to an unloading position.

Appropriate data processing programs can be utilized to display the various parameter and exercising efforts of the user, to compare two or more exercise routines, to provide averages of various collected data, etc.

Figure 9:
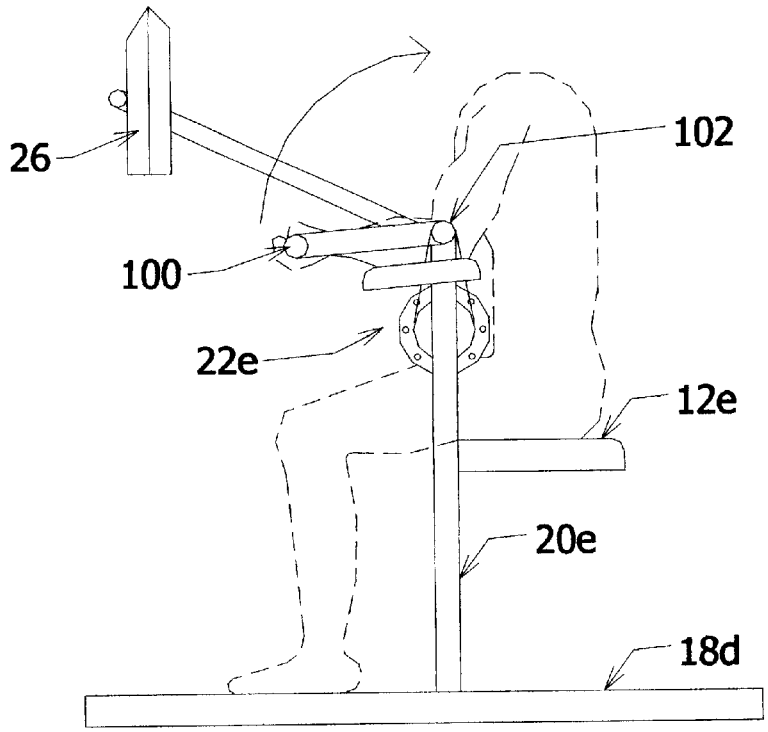
FIG. 9 is a side elevational view of an alternate embodiment of an exercise devise in accordance with the invention.
Figure 10:
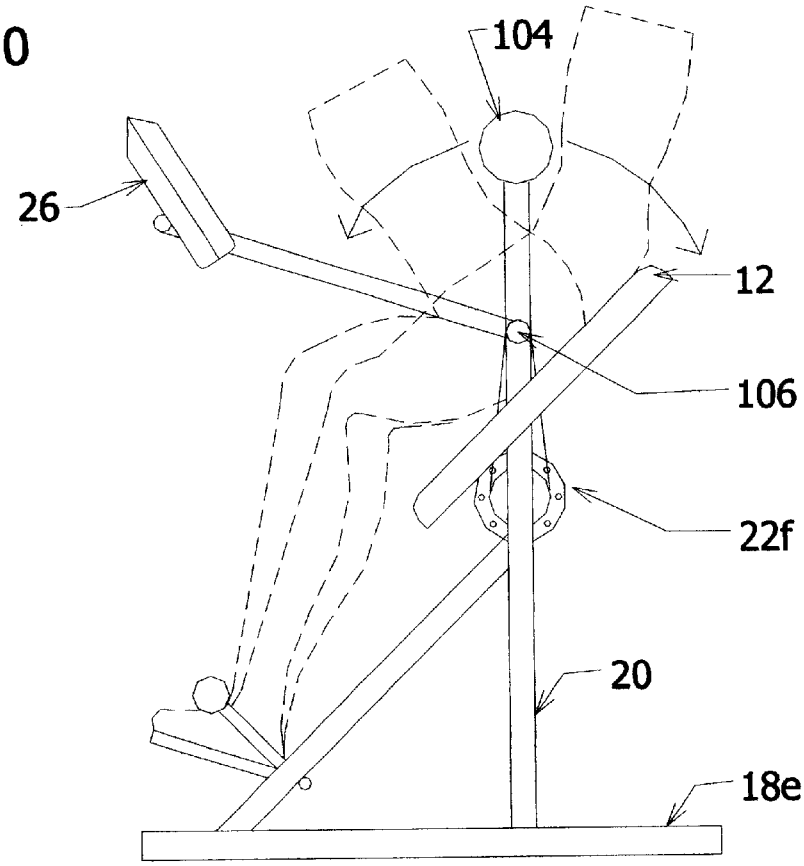
FIG. 10 is a side elevational view of an alternate embodiment of an exercise devise in accordance with the invention.

FIGS. 9 and 10 schematically illustarts other type of exercise devises which embody various principles of the present invention. For example, in FIG. 9, an arm exercising devise is illustrated in which a hand grip 100 is pivoted about a pivot point 102 which is connected to resistance devise 22*e*. A user is supported on a support surface 12*e* which is mounted on a sub-frame 20*e* which is connected to a main frame 18*a*. A display devise 26*e* is provided which can include a display screen and input devise as described above.

FIG. 10 shows a devise for exercising by means of movement at the hip to provide exercise for back and stomach muscles in which a padded cross bar 104 is engaged either by the stomach or back of a user and is pressed forward or backwards about a pivot point 106 and in which a resistance devise 22*f* provides resistance against movement of the bar 104. Other similar components of the exercise devise are provided with common reference numbers with a small letter suffix.

Figure 11:
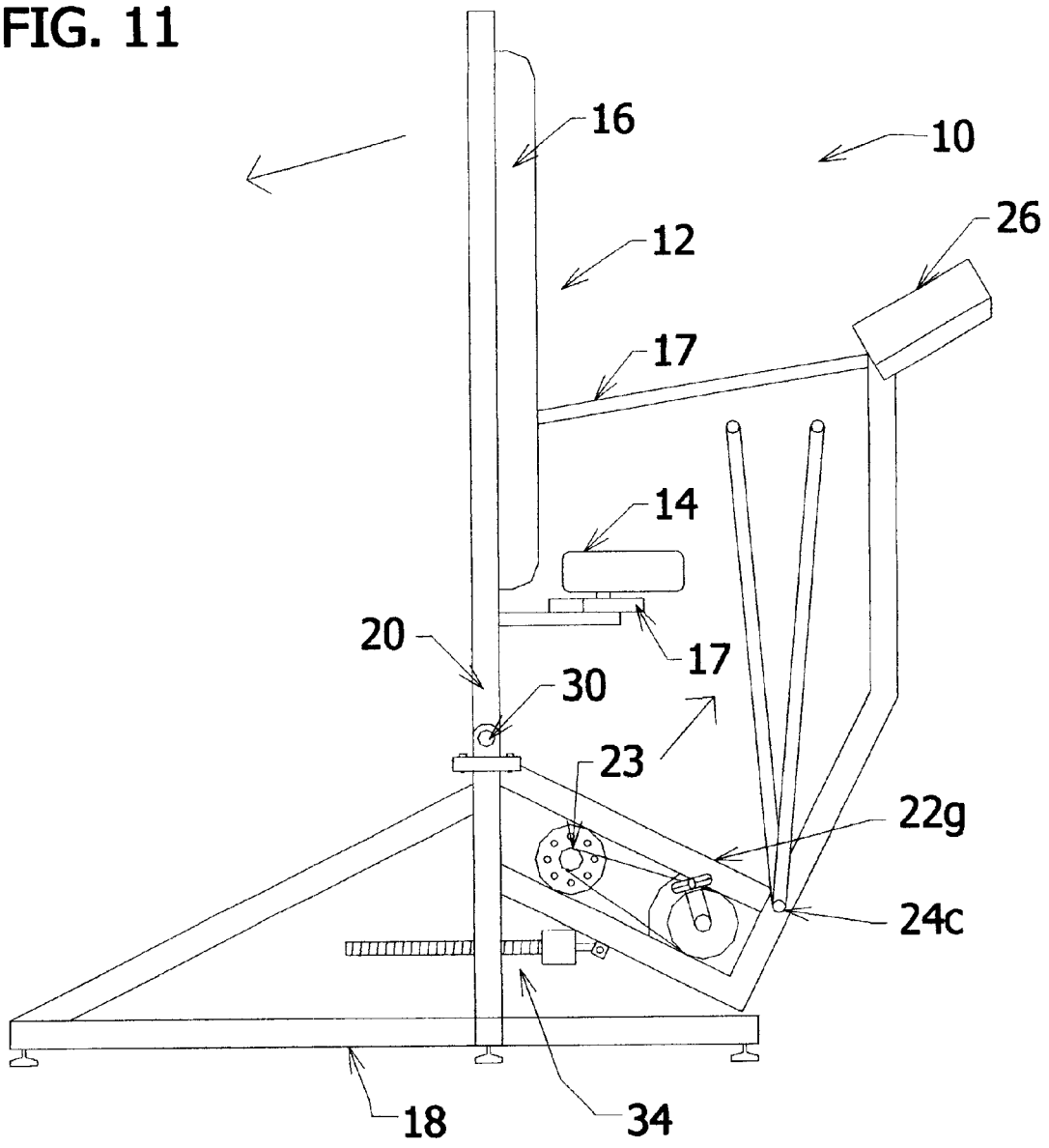
FIG. 11 is a side elevational view of FIG. 1 of an embodiment of varying components of resistance devises in accordance with the invention.

FIG. 11 shows other examples of what has been previously described herein. A resistance device 24*c* may be set up for an arm rowing motion. Also the resistance device 22*g* and 24*c* may be set up with multiple component configurations including a generator type motor means 23.

As is apparent from the foregoing specification (whether or not some items have been given more or less attention), the invention is susceptible of being embodied with various alterations and modifications which may differ particularly from those that have been described in the preceding specification, and description. It should be understood that I wish to embody within the scope of the patent warranted hereon all such modifications as reasonably and properly come within the scope of my contribution to the art.

I claim as my invention:

1. An exercise device comprising:

means for supporting a user above a floor;

means for changing an orientation of said means for supporting a user relative to said floor during an exercise routine;

means for user generating electrical energy wherein the electrical energy is used to change the orientation of said user.

2. An exercise device according to claim 1, further including means, engageable by said user and associated with said means for supporting a user and for providing resistance to movement of said user.

3. An exercise devise according to claim 2, further including means for adjusting an amount of resistance provided by said means for providing resistance during an exercise routine.

4. An exercise device according to claim 2, further including means for generating energy to power exercise devise.

5. An exercise device according to claim 2, wherein said means for providing resistance includes foot supports for engagement by feet of said user, said foot supports rotatably connected to said means for support of a user.

6. An exercise device according to claim 2, wherein said means for providing resistance includes graspable supports for engagement by hands of said user, said hand supports rotatably connected to said means for support of a user.

7. An exercise device according to claim 2, wherein said means for providing resistance includes graspable supports for engagement by hands of said user, said hand supports pivotally connected to said means for support of a user.

8. An exercise device according to claim 1, wherein said means for support of a user includes a seat and back rest.

9. An exercise device according to claim 1, wherein said means for support of a user includes foot supports.

10. An exercise devise according to claim 1, further including manually graspable support means for providing a user additional support.

11. An exercise device according to claim 10, wherein said means for support as a seat and said manually graspable support means includes hand grips positioned below said seat.

12. An exercise device according to claim 10, wherein said hand grips are secured to said means for supporting a user in a direction that a user would face when seated on said seat.

13. An exercise device according to claim 12, wherein said hand grips are secured to said means for supporting a user and wrap around to be directed in a direction that a user would face when seated on said seat.

14. An exercise device according to claim 10, further including means for adjusting the graspable support means closer to or further from the user.

15. An exercise device according to claim 1, further including a frame supporting said user above a floor.

16. An exercise device according to claim 15, wherein said frame includes a main frame engagable with the floor and a sub-frame attached to said surface and connecting means between said main frame and sub-frame to permit movement.

17. An exercise device according to claim 15, wherein said frame includes a main frame attached to said surface and engagable with the floor and a sub-frame attached to said resistance means and connecting means between said main frame and sub-frame to permit movement.

18. An exercise device according to claim 15, wherein said frame includes a main frame engagable with the floor and sub-frames attached to said surface and attached to said resistance means and connecting means between said main frame and sub-frames to permit movement.

19. An exercise device according to claim 1, wherein said means for changing orientation of said support surface includes a powered actuating device.

20. An exercise device according to claim 1, wherein said means for changing orientation of said means for supporting a user permits means to be adjustably oriented through a range from horizontal to vertical.

21. An exercise device according to claim 1, wherein said means for changing orientation of said means for supporting a user includes a pivot connection between said means for supporting a user, permitting a forward and rearward tilting of said user positioned on said means for supporting a user.

22. An exercise device according to claim 2, further including means for changing an orientation of said means, engageable by said user and associated with said means for supporting a user; for providing resistance to movement of said user.

23. An exercise device according to claim 22, wherein said means for changing orientation of said means for resistance permits said means for resistance to be adjustably oriented through a range from horizontal to vertical.

24. An exercise device according to claim 22, wherein said means for changing orientation of said means for resistance includes a pivot connection between said means for supporting a user, permitting a upward and downward tilting of said means for resistance.

25. An exercise device according to claim 1, wherein said means for changing orientation of said means for supporting a user and means for resistance permits means to be adjustably oriented through a range from horizontal to vertical.

26. An exercise device according to claim 1, wherein said means for changing orientation of said means for supporting a user and means for resistance includes a pivot connection between said means for supporting a user and means for resistance, permitting a forward and rearward tilting of said user positioned on said means for supporting a user and means for resistance.

27. An exercise device according to claim 1, wherein said means for changing orientation of said support permits said support to be adjustably oriented along an axis.

28. An exercise device according to claim 1, further including means for displaying selected information relating to use of said device by said user.

29. An exercise device according to claim 28, wherein said information includes a exercise program to be followed by said user.

30. An exercise device according to claim 28, wherein said information includes results of said movement of said user against said means for providing resistance.

31. An exercise device according to claim 28, further including means for transmitting said information to a location remote from said device.

32. An exercise device according to claim 28, further including means for transmitting said results to a location remote from said device.

33. An exercise device according to claim 1, wherein said exercise device includes a control system to operate said means for changing orientation.

34. An exercise device according to claim 2, wherein said exercise device includes a control system to operate said means for providing resistance to movement of said user.

35. An exercise device comprising:

a frame situated on the floor;

means for supporting a user;

means for changing an orientation of said means for supporting a user relative to said floor during an exercise routine;

means, engageable by said user and associated with said means for supporting a user; for providing resistance to movement of said user; and means for user generating electrical energy wherein the electrical energy is used to change the orientation of said user.

36. An exercise device according to claim 35, wherein said exercise device further includes a control system to operate means for changing orientation and of said means for providing resistance to movement of said user.

37. An exercise device comprising:

a frame situated on the floor;

means for supporting a user;

means for changing an orientation of said means for supporting a user relative to said floor during an exercise routine;

means, engageable by said user and associated with said means for supporting a user; for providing resistance to movement of said user;

means for user generating electrical energy wherein the electrical energy is used to change the orientation of said user;

means for displaying information relating to use of said device by said user; and means for controlling said device.

38. An exercise device according to claim 35, wherein said exercise device further includes a control system to operate means for changing orientation and of said means for providing resistance to movement of said user in harmony with each other.

39. An exercise device comprising:

A frame situated on the floor;

means for supporting a user;

means for changing an orientation of said means for supporting a user relative to said floor during an exercise routine;

means, engageable by said user and associated with said means for supporting a user; for providing resistance to movement of said user;

means for user generating electrical energy wherein the electrical energy is used to change the orientation of said user;

means for displaying information relating to use of said device by said user; and means for controlling said device and, wherein said control system further operates means for changing orientation and of said means for providing resistance to movement of said user in harmony with each other.

* * * * *

UNITED STATES PATENT AND TRADEMARK OFFICE

CERTIFICATE OF CORRECTION

PATENT NO. : 6,547,702 B1
DATED : April 15, 2003
INVENTOR(S) : Steven Heidecke

It is certified that error appears in the above-identified patent and that said Letters Patent is hereby corrected as shown below:

Title page,
Item (56), References Cited, insert the following:

-- OTHER PUBLICATIONS

| | | |
|---|---|---|
| 2,484,153 | K.J. Chaudoir, Sr. | October 11, 1949 |
| 2,784,591 | B.A. Shoor | March 12, 1957 |
| 3,189,591 | T.S. Swarts | June 15, 1965 |
| 3,540,435 | M.G. Smith | November 17, 1970 |
| 3,568,037 | Solihull et al. | March, 1970 |
| 3,589,193 | W.E. Thomton | June 29,1971 |
| 3,592,466 | Parsons | July, 1991 |
| 3,675,640 | J.D. Gatts | July 11, 1972 |
| 3,744,480 | R.I. Gause et al. | July 10, 1973 |
| 3,750,479 | Gause et al. | August, 1973 |
| 3,759,511 | Zinkin | Sept. 8, 1973 |
| 3,765,245 | F. Hampl | October 16, 1973 |
| 3,984,666 | B. Barron | October 5, 1976 |
| 4,053,173 | Chase, Sr. | October, 1977 |
| 4,060,239 | W. Pfleiderer et al. | November 29, 1977 |
| 4,112,928 | P. Patsch | September 12,1978 |
| 4,170,988 | N.J.P.R. Krause | October 16, 1979 |
| 4,184,678 | E. Flavell et al. | January 22, 1980 |
| 4,188,030 | Hooper | February 12, 1980 |
| 4,230,100 | D.E. Moon | October 28, 1980 |
| 4,244,021 | R.E. Chiles, III | January 6, 1981 |
| 4,285,515 | D.Y. Gezari | August 25, 1981 |
| 4,358,105 | Sweeny Jr. | Nov. 9, 1982 |
| 4,372,551 | C. Yurdin | February 8, 1983 |
| 4,477,072 | R.J. DeCloux | October 16, 1984 |
| 4,555,109 | Hartman | November, 1985 |
| 4,561,318 | Schirrmacher | December, 1985 |
| 4,613,129 | C.H. Schroeder et al. | September 23,1986 |
| 4,678,182 | Nakao et al. | July 7, 1987 |
| 4,746,116 | Inada | May, 1988 |
| 4,779,863 | Yang | October, 1988 |
| 4,790,528 | Nakao et al. | Dec. 13, 1988 |
| 4,817,938 | Nakao et al. | April 4, 1989 |
| 4,817,940, | B.F. Shaw et al. | April 4, 1989 |

UNITED STATES PATENT AND TRADEMARK OFFICE

CERTIFICATE OF CORRECTION

PATENT NO. : 6,547,702 B1
DATED : April 15, 2003
INVENTOR(S) : Steven Heidecke

It is certified that error appears in the above-identified patent and that said Letters Patent is hereby corrected as shown below:

OTHER PUBLICATIONS (cont.),

| | | |
|---|---|---|
| 4,822,037 | Makansi et al. | April 18, 1989 |
| 4,828,257 | R.A Dyer et al. | May 9, 1989 |
| 4,907,795 | A.D. Oosthuizen et al. | June 27, 1989 |
| 4,869,494 | Lambert, Sr. | September, 1989 |
| 4,938,474 | Sweeny, et al. | July 3, 1990 |
| 4,941,652 | Nagano, et al. | July, 17, 1990 |
| 4,949,954 | Hix | August, 1990 |
| 4,986,261 | lams et al. | January, 1991 |
| 5,038,758 | lams et al. | August, 1991 |
| 5,039,087 | Kuo | August, 1991 |
| 5,039,088 | Shifferaw | August, 1991 |
| 5,054,774 | A.W. Belsito | October 8, 1991 |
| 5,067,710 | Watterson et al. | Nov., 26, 1991 |
| 5,098,089 | Harrington, et al | March, 1992 |
| 5,131,895 | Rogers, Jr. | July, 1992 |
| 5,135,447 | Robards, Jr. et al. | August, 1992 |
| 5,142,358 | L.A. Jason | August 25, 1992 |
| 5,186,697 | Rennex | Febraury 16, 1993 |
| 5,205,800 | Grant | April, 1993 |
| 5,233,987 | L.Fabian et al. | August 10, 1993 |
| 5,267,925 | Boyd | Dec. 7, 1993 |
| 5,279,529 | Eschenbach | January, 1994 |
| 5,290,211 | Stearns | March 1, 1994 |
| 5,295,928 | Rennex | March, 1994 |
| 5,318,487 | Golen et al. | June 7, 1994 |
| 5,788,610 | Eschenbach | October, 1994 |
| 5,401,226 | Stearns | March 28, 1995 |
| 5,518,473 | Miller | March, 1995 |
| 5,527,246 | Rodgers, Jr. | June, 1996 |
| 5,529,555 | Rodgers, Jr. | June, 1996 |
| 5,540,637 | Rodgers | July, 1996 |
| 5,577,985 | Miller | November, 1996 |
| 5,593,372 | Rodgers | January, 1997 |
| 5,611,756 | Miller | March, 1997 |
| 5,611,758 | Rodgers, Jr. | March 18, 1997 |
| 5,685,804 | Whan-Tong et al. | Nov. 11, 1997 |
| 5,690,589 | Rodgers, Jr. | November, 1997 |
| 5,743,834 | Rodgers, Jr. | April, 1998 |
| 5,759,135 | Chen | June 2, 1998 |
| 5,759,136 | Chen | June 2, 1998 |

UNITED STATES PATENT AND TRADEMARK OFFICE

CERTIFICATE OF CORRECTION

PATENT NO. : 6,547,702 B1
DATED : April 15, 2003
INVENTOR(S) : Steven Heidecke

It is certified that error appears in the above-identified patent and that said Letters Patent is hereby corrected as shown below:

OTHER PUBLICATIONS (cont.),

| | | |
|---|---|---|
| 5,785,631 | Heidecke | July 28, 1998 |
| 5,853,351 | Maruo et al. | Dec. 28, 1998 |
| 5,895,339 | Maresh | April 20, 1999 |
| 5,938,570 | Maresh | August 17, 1999 |
| 6,019,710 | Dalebout et al. | February 1, 2000 -- |

Signed and Sealed this

Twentieth Day of July, 2004

JON W. DUDAS
*Acting Director of the United States Patent and Trademark Office*